US009940864B2

(12) United States Patent
Nakamura et al.

(10) Patent No.: US 9,940,864 B2
(45) Date of Patent: Apr. 10, 2018

(54) DISPLAY DEVICE AND METHOD FOR DRIVING SAME

(71) Applicant: Sharp Kabushiki Kaisha, Sakai, Osaka (JP)

(72) Inventors: Yousuke Nakamura, Sakai (JP); Tatsuhiko Suyama, Sakai (JP); Teruhisa Masui, Sakai (JP); Kentaroh Uemura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/318,451

(22) PCT Filed: Jun. 18, 2015

(86) PCT No.: PCT/JP2015/067583

§ 371 (c)(1),
(2) Date: Dec. 13, 2016

(87) PCT Pub. No.: WO2015/198957

PCT Pub. Date: Dec. 30, 2015

(65) Prior Publication Data

US 2017/0148370 A1 May 25, 2017

(30) Foreign Application Priority Data

Jun. 25, 2014 (JP) ..... 2014-130653

(51) Int. Cl.
*G09G 3/36* (2006.01)
*G09G 3/20* (2006.01)

(52) U.S. Cl.
CPC ..... *G09G 3/2044* (2013.01); *G09G 3/3677* (2013.01); *G09G 2310/08* (2013.01); *G09G 2320/0233* (2013.01)

(58) Field of Classification Search
CPC ..... G09G 3/2044; G09G 3/3677; G09G 2320/0233; G09G 2310/08
See application file for complete search history.

(56) References Cited

U.S. PATENT DOCUMENTS

2012/0138922 A1 6/2012 Yamazaki et al.
2012/0320025 A1 12/2012 Tamaki
(Continued)

FOREIGN PATENT DOCUMENTS

JP 2012-134475 A 7/2012
JP 2013-3467 A 1/2013
WO 2013/008668 A1 1/2013

*Primary Examiner* — Andrew Sasinowski
(74) *Attorney, Agent, or Firm* — Keating & Bennett, LLP

(57) ABSTRACT

There is provided a display device that is capable of suppressing occurrence of brightness drop which is caused by refresh of a display image during pause driving. In a normal driving mode, input image data (SsD0) according to a continuous tone method is supplied to a source driver (310) through a data selector (230) as an image signal (SsD) for driver. On the other hand, in a low-frequency driving mode in which pause driving is performed, the input image data (SsD0) is converted into dithered input image data (SsD1) by a dithering processing circuit (220), and is supplied to the source driver (310) through the data selector (230) as the image signal (SsD) for driver. A gradation of the dithered input image data (SsD1) is represented in a pseudo manner by an area coverage modulation method by using two values of a maximum value and a minimum value that can be taken as the gradation value of the input image data (SsD0).

8 Claims, 6 Drawing Sheets

(56) References Cited

U.S. PATENT DOCUMENTS

| | | | | |
|---|---|---|---|---|
| 2014/0125569 | A1* | 5/2014 | Nakata | G09G 3/3648 345/87 |
| 2015/0029167 | A1* | 1/2015 | Tanaka | H04N 5/66 345/204 |
| 2015/0116195 | A1* | 4/2015 | Yokonuma | G09G 3/3406 345/102 |

* cited by examiner

| | | | |
|---|---|---|---|
| 0 | 128 | 32 | 160 |
| 192 | 64 | 224 | 96 |
| 48 | 176 | 16 | 144 |
| 240 | 112 | 208 | 80 |

DISPLAY DEVICE AND METHOD FOR DRIVING SAME

TECHNICAL FIELD

The present invention relates to a display device and a method for driving the same, and more particularly, to a display device that performs pause driving and a method for driving the same.

BACKGROUND ART

A plurality of pixel formation portions are formed in a matrix form on a display unit of an active matrix-type liquid crystal display device. Each pixel formation portion is provided with a thin film transistor (hereinafter "TFT") that operates as a switching element, and a pixel capacitance that is connected to a data signal line via the TFT. By turning on/off the TFT, a data signal for displaying an image is written in the pixel capacitance in the pixel formation portion as a data voltage. The data voltage is applied to a liquid crystal layer of the pixel formation portion, and changes the alignment direction of liquid crystal molecules according to a voltage value of the data signal. The liquid crystal display device thereby displays an image on the display unit by controlling the light transmittance of the liquid crystal layer of each pixel formation portion.

In the case where such a liquid crystal display device is to be used in a portable electronic device or the like, the power consumption is desired to be more reduced than in the conventional case. Accordingly, there is proposed a method for driving a display device according to which a pause period (referred to also as "non-refresh period") during which all the gate lines as scanning signal lines of the liquid crystal display device are placed in a non-scanning state and refresh is paused is provided after a scanning period (referred to also as "refresh period") during which the gate lines are scanned and a display image is refreshed (for example, see Patent Document 1). For example, in the pause period, control signals and the like may be prevented from being provided to a gate driver as a scanning signal line drive circuit and/or a source driver as a data signal line drive circuit. This allows the operation of the gate driver and/or the source drive to be paused, and thus, the power consumption may be reduced. Driving that is performed by providing a pause period after a refresh period, such as the driving method disclosed in Patent Document 1, is called "pause driving", for example. Additionally, the pause driving may also be referred to as "low-frequency driving" or "intermittent driving". Such pause driving is suitable for still image display.

PRIOR ART DOCUMENTS

Patent Documents

[Patent Document 1] Japanese Unexamined Patent Application Publication No. 2013-3467

[Patent Document 2] WO 2013/008668 A

SUMMARY OF THE INVENTION

Problems to be Solved by the Invention

With a liquid crystal display device that performs pause driving as described above, a phenomenon occurs where brightness of image display is reduced at the time of refresh of a display image (referred to as "brightness drop"). The brightness drop is particularly great at a part that is displayed in halftone, and the quality of the display image is thereby reduced. Such reduction in the image quality is easily perceived when the interval between refreshes of the display image is increased due to pause driving.

Accordingly, the present invention has its object to provide a display device which is capable of suppressing brightness drop caused by refresh of a display image during pause driving, and a method for driving the same.

Means for Solving the Problems

A first aspect of the present invention provides a display device for receiving an input signal including image data according to a continuous tone method from outside, and displaying an image based on the input signal, the display device comprising:

a display unit;

a drive unit configured to drive the display unit; and a display control unit configured to control the drive unit so that an image is displayed on the display unit based on the input signal, the display device having:

a normal driving mode in which the display unit is driven in such a way that a refresh period appears continuously, the refresh period being a period during which a display image on the display unit is refreshed; and a low-frequency driving mode in which the display unit is driven in such a way that the refresh period and a non-refresh period appear alternately, the non-refresh period being a period during which refresh of the display image on the display unit is paused, the display control unit including an image processing unit configured to perform, on a part or all of the image data, in the low-frequency driving mode, a conversion process of converting a gradation method so that the image is displayed on the display unit according to an area coverage modulation method.

A second aspect of the present invention provides the display device according to the first aspect of the present invention, wherein the image processing unit performs the conversion process on the image data in such a way that a gradation is expressed in a pseudo manner by a dithering method that takes a plurality of pixels as a unit.

A third aspect of the present invention provides the display device according to the first aspect of the present invention, wherein the image processing unit performs the conversion process on the image data in such a way that pixels, among pixels in a continuous tone image represented by the image data, whose gradations are representable within a predetermined error range by a dithering method that takes two or a greater predetermined number of pixels as a unit are changed to pixels according to the dithering method, and that pixels, among the pixels in the continuous tone image, whose gradations are not representable within the predetermined error range by the dithering method remain as pixels according to the continuous tone method.

A fourth aspect of the present invention provides the display device according to the first aspect of the present invention, wherein the image processing unit determines in advance, as numbers of pixels as units of gradation representation by the dithering method, at least two numbers of pixels including a first number of pixels and a second number of pixels greater than the first number of pixels, and performs the conversion process on the image data in such a way that pixels, among pixels in a continuous tone image represented by the image data, whose gradations are representable within a predetermined error range by a first dithering method that takes the first number of pixels as a unit are changed to pixels according to the first dithering method, that pixels, among the pixels in the continuous tone image, whose gradations are not representable within the predetermined error range by the first dithering method but are representable within a predetermined error range by a second dithering method that takes the second number of pixels as a unit are changed to pixels according to the second dithering method, and that pixels, among the pixels in the continuous tone image, whose gradations are not representable within a predetermined error range by the dithering method that takes either of the at least two numbers of pixels as a unit remain as pixels according to the continuous tone method.

A fifth aspect of the present invention provides the display device according to any one of the first to fourth aspects of the present invention, wherein the area coverage modulation method is a method that expresses a gradation, in a pseudo manner, by a dithering method that uses two values of a maximum gradation value and a minimum gradation value that can be taken by a pixel in an image represented by the image data.

A sixth aspect of the present invention provides the display device according to any one of the first to fifth aspects of the present invention, wherein the display unit includes, as a switching element for forming each pixel constituting an image to be displayed, a thin film transistor whose channel layer is formed of an oxide semiconductor.

Descriptions of other aspects of the present invention are omitted since those aspects are apparent from the first to sixth aspects of the present invention described above and from description of each embodiment described later.

Effects of the Invention

According to the first aspect of the present invention, in the normal driving mode, the display unit is driven in such a way that the refresh period during which a display image is refreshed appears continuously, and in the low-frequency driving mode, the display unit is driven in such a way that the refresh period during which a display image is refreshed and the non-refresh period during which refresh of the display image is paused appear alternately. More specifically, in the refresh period in the normal driving mode, the display unit is driven in such a way that an image represented by image data according to the continuous tone method is displayed on the display unit. On the other hand, in the refresh period in the low-frequency driving mode, the display unit is driven in such a way that a part or all of image data, according to the continuous tone method, included in an input signal received from outside is converted into image data according to the area coverage modulation method, and that an image represented by the image data according to the area coverage modulation method is displayed. Accordingly, display of pixels of intermediate gradation values is suppressed in the low-frequency driving mode, and brightness drop at the time of refresh in the low-frequency driving mode is therefore reduced or overcome.

According to the second aspect of the present invention, in the low-frequency driving mode, the conversion process of converting a gradation method so that a gradation is expressed in a pseudo manner by the dithering method that takes a plurality of pixels as a unit is performed on image data, and thus, brightness drop at the time of refresh in the low-frequency driving mode may be reduced or overcome without changing the configuration or control timing of the drive unit.

According to the third aspect of the present invention, in the low-frequency driving mode, the display unit is driven in such a way that image data in an input signal is converted into partially dithered image data including data which is dithered in units of two or a greater predetermined number of pixels (binary image data whose gradation is represented in a pseudo manner by the dithering method) and data, according to the continuous tone method, which is not subjected to the dithering processing, and that an image represented by the partially dithered image data is displayed. This allows the brightness drop at the time of refresh in the low-frequency driving mode to be reduced while suppressing reduction in the gradation reproducibility by the dithering processing, and the relationship of trade-off between the gradation reproducibility and suppression in the brightness drop may be adjusted by setting an allowable error for the dithering processing.

According to the fourth aspect of the present invention, in the low-frequency driving mode, the display unit is driven in such a way that image data in an input signal is converted into partially dithered image data including data which is dithered in units of a first number of pixels, data which is dithered in units of a second number of pixels, and data, according to the continuous tone method, which is not subjected to the dithering processing, and that an image represented by the partially dithered image data is displayed. This allows the brightness drop at the time of refresh in the low-frequency driving mode to be reduced while suppressing reduction in the gradation reproducibility by the dithering processing, and the relationship of trade-off between the gradation reproducibility and suppression in the brightness drop may be more finely adjusted by setting an allowable error for the dithering processing in each of two stages.

According to the fifth aspect of the present invention, a part or all of image data in an input signal is converted into binary image data whose gradation is represented in a pseudo manner by the dithering method, and each pixel value of the binary image data takes one of a maximum gradation value and a minimum gradation value. This allows the brightness drop at the time of refresh in the low-frequency driving mode to be reliably reduced.

According to the sixth aspect of the present invention, a thin film transistor whose channel layer is formed of an oxide semiconductor is used as the switching element for forming each pixel constituting an image to be displayed on the display unit, and thus, the off-leakage current of the thin film transistor is greatly reduced, and pause driving of the display device may therefore be suitably performed.

Descriptions of effects of other aspects of the present invention are omitted since those effects are apparent from the description of the effects of the first to the sixth aspects of the present invention described above, and of the embodiments described below.

BRIEF DESCRIPTION OF THE DRAWINGS

FIGS. 5(A) to 5(E) are diagrams for describing a dithering processing according to a variation of the first embodiment.

MODES FOR CARRYING OUT THE INVENTION

Hereinafter, each embodiment of the present invention will be described. In each of the following embodiments, description will be given taking as an example an active matrix-type liquid crystal display device that performs pause driving. Additionally, in the following, "one frame period" is a period for refreshing one screen of a display image, and the length of the "one frame period" is the length (16.67 ms) of one frame period of a general display device whose refresh rate is 60 Hz, but the present invention is not limited thereto.

1. First Embodiment

1.1. Overall Configuration and Outline of Operation

Figure 1:
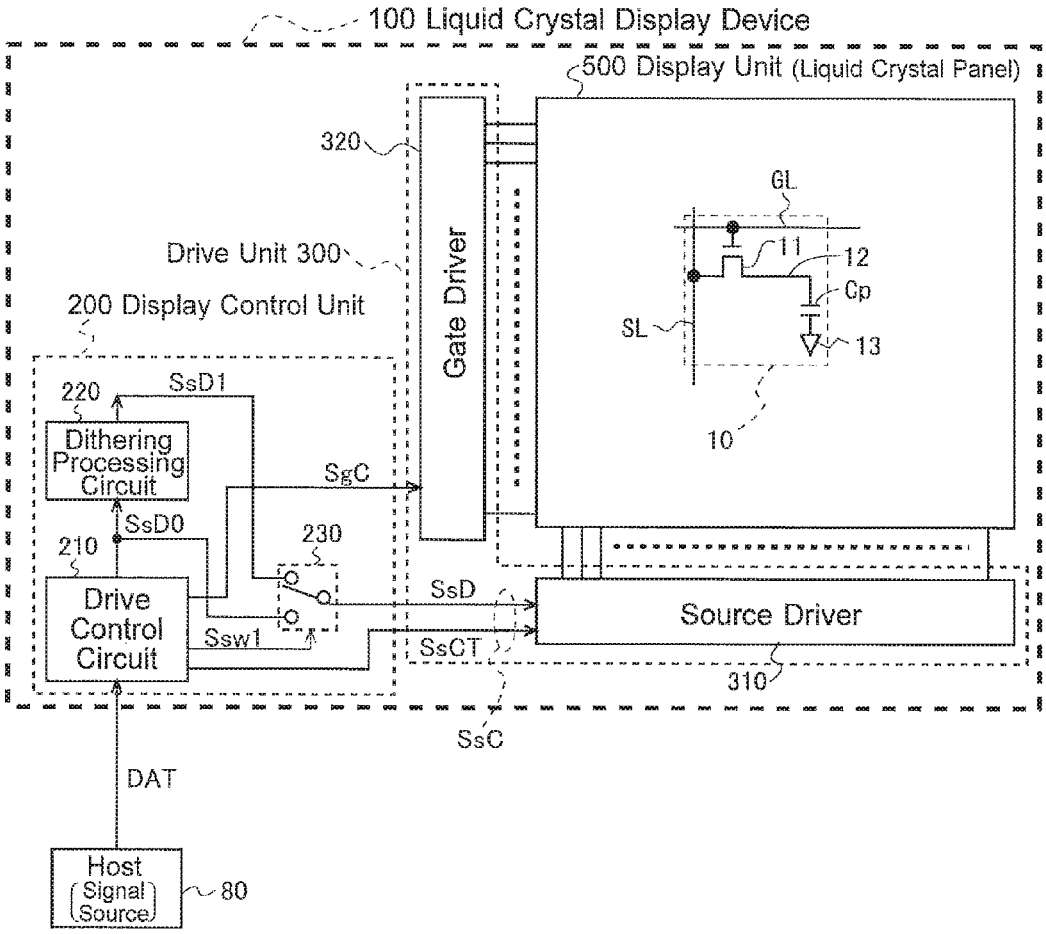
FIG. 1 is a block diagram showing a configuration of a liquid crystal display device according to a first embodiment of the present invention.

FIG. 1 is a block diagram showing a configuration of a liquid crystal display device 100 according to a first embodiment of the present invention. The liquid crystal display device 100 includes a display control unit 200, a drive unit 300, and a display unit 500. The drive unit 300 includes a source driver 310 as a data signal line drive circuit, and a gate driver 320 as a scanning signal line drive circuit. The display unit 500 forms a liquid crystal panel, and the liquid crystal panel may be structured such that the display unit 500 is integrally formed with one or both of the source driver 310 and the gate driver 320. A host 80, which is mainly composed of a central processing unit (CPU), is provided as a signal source outside the liquid crystal display device 100.

In the display unit 500, a plurality (m) of data signal lines SL1 to SLm, a plurality (n) of scanning signal lines GL1 to GLn, and a plurality (m×n) of pixel formation portions 10 are formed. The plurality (m×n) of pixel formation portions 10 are arranged in a matrix form in a manner corresponding to the plurality of data signal lines SL1 to SLm and the plurality of scanning signal lines GL1 to GLn. In the following, a reference character "SL" is used when there is no need to distinguish among the m data signal lines SL1 to SLm, and a reference character "GL" is used where there is no need to distinguish among the n scanning signal lines GL1 to GLn, and in FIG. 1, for the sake of convenience, one pixel formation portion 10, and one data signal line SL and one scanning signal line GL corresponding to the pixel formation portion 10 are shown. Each pixel formation portion 10 includes a thin film transistor (TFT) 11 as a switching element whose gate terminal is connected to the corresponding scanning signal line GL and whose source terminal is connected to the corresponding data signal line SL, a pixel electrode 12 that is connected to a drain terminal of the TFT 11, a common electrode 13 that is provided in common for the plurality of pixel formation portions 10, and a liquid crystal layer that is interposed between the pixel electrode 12 and the common electrode 13 and that is provided in common for the plurality of pixel formation portions 10. Moreover, a liquid crystal capacitance formed by the pixel electrode 12 and the common electrode 13 constitutes a pixel capacitance Cp. Additionally, typically, an auxiliary capacitance is provided in parallel to the liquid crystal capacitance so that voltage is reliably held at the pixel capacitance Cp, and in reality, the pixel capacitance Cp is formed from the liquid crystal capacitance and the auxiliary capacitance.

In the present embodiment, as the TFT 11, a TFT using an oxide semiconductor layer as a channel layer (hereinafter referred to as "oxide TFT") is used. The oxide semiconductor layer includes an In—Ga—Zn—O-based semiconductor, for example. Here, the In—Ga—Zn—O-based semiconductor is a ternary oxide of indium (In), gallium (Ga) and zinc (Zn), and the ratio (composition ratio) of In, Ga and Zn is not particularly limited, and may be In:Ga:Zn=2:2:1, In:Ga:Zn=1:1:1, In:Ga:Zn=1:1:2, or the like. In the present embodiment, an In—Ga—Zn—O-based semiconductor film containing In, Ga and Zn in the ratio of 1:1:1 is used.

A TFT including an In—Ga—Zn—O-based semiconductor layer has high mobility (more than 20 times compared to a TFT that uses amorphous silicon as a channel layer, that is, an a-SiTFT) and low leakage current (less than a hundredth compared to the a-SiTFT), and is suitably used as a drive TFT and a pixel TFT. If a TFT including an In—Ga—Zn—O-based semiconductor layer is used, the power consumption of a display device may be greatly reduced.

The In—Ga—Zn—O-based semiconductor may be amorphous, or may include a crystalline portion and may have crystallinity. As a crystalline In—Ga—Zn—O-based semiconductor, a crystalline In—Ga—Zn—O-based semiconductor whose c-axis is aligned approximately perpendicularly to the layer surface is desirable. The crystal structure of such an In—Ga—Zn—O-based semiconductor is disclosed in Japanese Unexamined Patent Application Publication No. 2012-134475, for example. The entire contents of Japanese Unexamined Patent Application Publication No. 2012-134475 are incorporated herein by reference.

The oxide semiconductor layer may include another oxide semiconductor instead of the In—Ga—Zn—O-based semiconductor. For example, a Zn—O-based semiconductor (ZnO), an In—Zn—O-based semiconductor (IZO (registered trademark)), a Zn—Ti—O-based semiconductor (ZTO), a Cd—Ge—O-based semiconductor, a Cd—Pb—O-based semiconductor, a cadmium oxide (CdO), a Mg—Zn—O-based semiconductor, an In—Sn—Zn—O-based semiconductor (for example, $In_2$—$O_3$—$SnO_2$—ZnO), or an In—Ga—Sn—O-based semiconductor may be included. Additionally, usage of an oxide TFT as the TFT 11 is only an example, and a silicon-based TFT or the like may be used as an alternative.

Typically, the display control unit 200 is implemented as an integrated circuit (IC). The display control unit 200 receives, from the host 80, input data DAT including input image data representing an image to be displayed, and accordingly generates a source driver control signal SsC, a gate driver control signal SgC, a common voltage signal, and the like. The source driver control signal SsC includes an image signal SsD for driver and a timing control signal SsCT, and is supplied to the source driver 310. The gate driver control signal SgC is supplied to the gate driver 320. The common voltage signal (not shown) is supplied to the common electrode 13 in the display unit 500.

The source driver 310 generates and outputs, according to the source driver control signal SsC, data signals S1 to Sm to be supplied to the data signal lines SL1 to SLm, respectively. Of the source driver control signal SsC, the image signal SsD for driver represents an image to be displayed, and the timing control signal SsCT includes a source start pulse signal, a source clock signal, a latch strobe signal, a polarity switching control signal, and the like. The source driver 310 operates a shift register, a sampling latch circuit and the like, not shown, that are provided inside, according to the timing control signal SsCT, and generates the data signals S1 to Sm by converting a plurality of digital signals obtained on the basis of the image signal SsD for driver into analog signals by a DA converter circuit, not shown.

The gate driver 320 repeatedly applies, at predetermined intervals, an active scanning signal to each scanning signal line GL according to the gate driver control signal SgC to thereby successively select the scanning signal lines GL1 to GLn, in other words, to scan the scanning signal lines GL1 to GLn, at predetermined intervals. For example, a gate clock signal and a gate start pulse signal are included in the gate driver control signal SgC. The gate driver 320 operates a shift register and the like, not shown, that are provided inside, according to the gate clock signal and the gate start pulse signal, and thereby generates the scanning signal.

A backlight unit (not show) is provided on the rear surface side of the display unit 500, and irradiates the rear surface of the display unit 500 with backlight. The backlight unit may be controlled by the display control unit 200, or may be controlled by other means. Additionally, the backlight unit does not have to be provided in the case where the liquid crystal panel is a reflective liquid crystal panel.

As described above, when the input data DAT transmitted from the host 80 is received at the liquid crystal display device 100 as an input signal, the liquid crystal display device 100 applies a data signal to each data signal line SL and applies a scanning signal to each scanning signal line GL on the basis of the input signal, and the backlight unit is driven, and an image based on input image data included in the data signal DAT from the host 80 is displayed on the display unit 500 of the liquid crystal panel.

1.2. Operation Mode

The liquid crystal display device 100 according to the present embodiment has two operation modes with respect to driving of the display unit 500, namely, a normal driving mode and a low-frequency driving mode. In the present embodiment, control information specifying which of the normal driving mode and the low-frequency driving mode is to be used for operation of the liquid crystal display device 100 is included in the input data DAT from the host 80, but the configuration for specifying the operation mode is not limited thereto. For example, the operation mode may be switched between the normal driving mode and the low-frequency driving mode by manual operation of a switch, not shown.

In the present embodiment, the scanning signal lines GL1 to GLn at the display unit 500 are successively selected by the gate driver 320, and also, a plurality of data signals S1 to Sm representing an image to be displayed are respectively applied to the data signal lines SL1 to SLm in the display unit 500 by the source driver 310. Accordingly, voltage held as pixel data at the pixel capacitance Cp of each pixel formation portion 10 of the display unit 500 is rewritten; that is, refresh of the display image on the display unit 500 is performed. In the normal driving mode, the drive unit 300 (the source driver 310, the gate driver 320, and the like) is controlled by the display control unit 200 in such away that only a refresh period, during which refresh of the display image is performed, is to appear repeatedly. Additionally, operation of a dithering processing circuit 220 is stopped in the normal driving mode.

Figure 2:
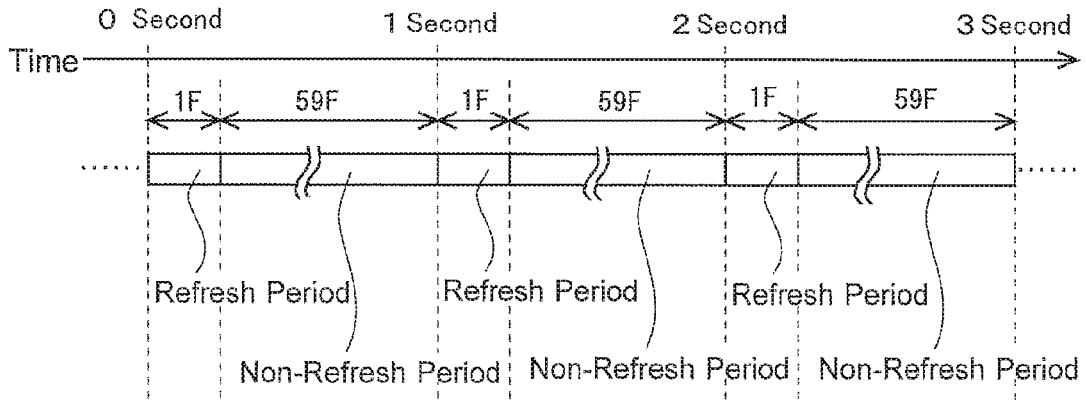
FIG. 2 is a timing chart for describing an example of operation in a low-frequency driving mode of the first embodiment.

On the other hand, in the low-frequency driving mode, the drive unit 300 is controlled by the display control unit 200 in such a way that the refresh period, during which refresh of the display image is performed, and a non-refresh period, during which all the scanning signal lines are placed in a non-selected state and refresh is paused, are alternately repeated. FIG. 2 is a timing chart for describing an example of operation in the low-frequency driving mode of the present embodiment. In this example, writing of one screen of pixel data (hereinafter referred to as "display image data") is performed during one frame period, and writing of the display image data is paused during the following 59 frame periods. That is, the display unit 500 of the liquid crystal display device 100 is driven in such a way that the refresh period, including one refresh frame period, and a non-refresh period, including 59 pause frame periods, appear alternately. Accordingly, the refresh rate is 1 Hz, and the refresh cycle is one second.

1.3. Configuration of Display Control Unit

As shown in FIG. 1, the display control unit 200 of the present embodiment includes a drive control circuit 210, a dithering processing circuit 220, and a data selector 230. The drive control circuit 210 corresponds to a timing controller serving as a display control unit of a conventional liquid crystal display device, and generates and outputs, based on input data DAT from the host 80, the gate driver control signal SgC and the timing control signal SsCT for the source driver, and also, extracts and outputs input image data SsD0 from the data DAT, and furthermore, generates and outputs a selection control signal Ssw1. The gate driver control signal SgC is supplied to the gate driver 310, the timing control signal ScCT for the source driver is supplied to the source driver 320, and the selection control signal Ssw1 is supplied to the data selector 230. The input image data SsD0 is digital data representing an image to be displayed according to a continuous tone method, and is supplied to the dithering processing circuit 220 and the data selector 230.

The dithering processing circuit 220 functions as an image processing unit for performing a process of converting a gradation method of input image data. That is, the dithering processing circuit 220 takes four pixels (hereinafter referred to as "2×2 pixels" or "adjacent four pixels"), with two pixels adjacent to each other in the horizontal direction and the vertical direction, respectively, as one unit, and performs dithering processing on the input image data SsD0 according to the continuous tone method, to thereby generate image data representing a gradation according to an area coverage modulation method (hereinafter referred to "area coverage modulation image data"). The area coverage modulation image data expresses the gradation in binary, in a pseudo manner, using a maximum value Lmax and a minimum value Lmin which may be given as gradation values of pixels (hereinafter referred to as "pixel value") of a continuous tone image, which is the image represented by the input image data.

Figure 3:
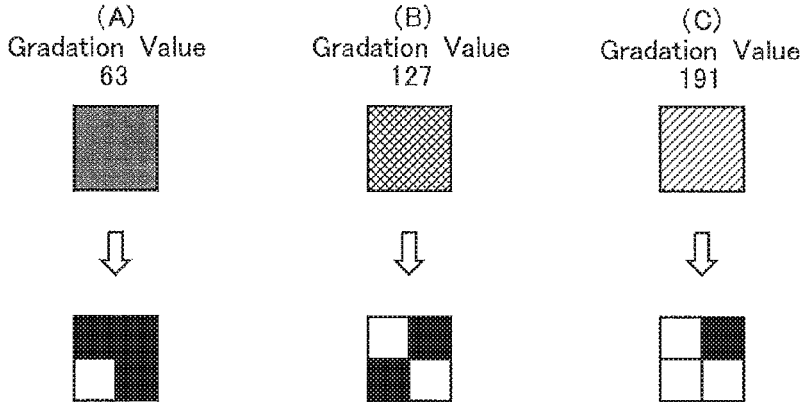
FIGS. 3(A) to 3(C) are diagrams for describing a dithering processing according to the first embodiment.

The area coverage modulation method is a method of expressing a gradation in binary in a pseudo manner, and expresses the gradation in a pseudo manner by the area ratio between the two values, that is, the ratio between the number of pixels having one of the two values and the number of pixels having the other value. For example, when assuming that the gradation value that can be taken by a pixel of the continuous tone image ranges from 0 to 255, and that the number of gradations is 256, a gradation value 63 is obtained by making the gradation value (pixel value) of one pixel among the adjacent four pixels, as a unit of dithering processing, 255 and the gradation values (pixel values) of the remaining three pixels 0 as shown in FIG. 3(A). Also, as shown in FIG. 3(B), a gradation value 127 is obtained by making the gradation values of two pixels, among the adjacent four pixels, 255 and the gradation values of the remaining two pixels 0, and as shown in FIG. 3(C), a gradation value 191 is obtained by making the gradation values (pixel values) of three pixels, among the adjacent four pixels, 255 and the gradation value of the remaining one pixel 0. Additionally, the gradation values of the adjacent four pixels are all made 0 for a gradation value 0, and the gradation values of the adjacent four pixels are all made 255 for a gradation value 255. Accordingly, in the case where the average gradation value of adjacent four pixels of the input image data SsD0 is equal to any one of five gradation values of 0, 63, 127, 191 and 255, the dithering processing circuit 220 converts the adjacent four pixels into adjacent four pixels of binary pixels corresponding to the average gradation value. Also, in the case where the average gradation value of adjacent four pixels of the input image data SsD0 is a gradation value other than the five gradation values of 0, 63, 127, 191 and 255, the dithering processing circuit 220 performs conversion into adjacent four pixels of binary pixels corresponding to a gradation value that is closest to the average gradation value (that is, a gradation value that is assumed to be equal to the average gradation value within a predetermined error range) among the five gradation values.

In the above manner, the dithering processing circuit 220 converts supplied input image data SsD0 from data according to the continuous tone method to data according to the area coverage modulation method in units of adjacent four pixels. Image data SsD1 that is obtained by this conversion (hereinafter referred to as "dithered input image data") is supplied to the data selector 230.

The data selector 230 selects, according to the selection control signal Ssw1, one of the input image data SsD0 from the drive control circuit 210 and the dithered input image data SsD1 from the dithering processing circuit 220. In the case of the normal driving mode, the drive control circuit 210 supplies, to the data selector 230, a low level (L level) as the selection control signal Ssw1, and in the case of the low-frequency driving mode, the drive control circuit 210 supplies, to the data selector 230, a high level (H level) as the selection control signal Ssw1. Thus, the data selector 230 selects the input image data SsD0 in the normal driving mode, and selects the dithered input image data SsD1 in the low-frequency driving mode, and the selected input image data SsD0 or dithered input image data SsD1 is supplied to the source driver 310 as the image signal SsD for driver representing the image to be displayed.

1.4. Operation and Effect

According to the present embodiment as described above, input data DAT from the host 80 is supplied to the display control unit 200, and whether the mode is the normal driving mode or the low-frequency driving mode is determined by the drive control circuit 210 in the display control unit 200 on the basis of the input data DAT, and in the case of the normal driving mode, the gate driver control signal SgC and the timing control signal SsCT are generated on the basis of the input data DAT, and also, the input image data SsD0 is extracted from the input data DAT, and the L level is output as the selection control signal Ssw1. Of the signals that are obtained at this time, the gate driver control signal SgC is supplied to the gate driver 320 and the timing control signal SsCT is supplied to the source driver 310, and the input image data SsD0 is selected by the data selector 230 on the basis of the L-level selection control signal Ssw1 and is supplied to the source driver 310 (as the image signal SsD for driver). In the display unit 500, the scanning signal lines GL1 to GLn are successively selected by the gate driver 320 on the basis of the gate driver control signal SgC, and also, the data signals S1 to Sm are applied to the data signal lines SL1 to SLm, respectively, by the source driver 310 on the basis of the image signal SsD for driver and the timing control signal SsCT. The display unit 500 (the scanning signal lines GL1 to GLn and the data signal lines SL1 to SLm therein) is driven in this manner, and the pixel data of each pixel formation portion 10 is rewritten, and the display image is thereby refreshed. Such refresh of display image is repeatedly performed at an interval of one frame period.

On the other hand, in the case where the mode is determined to be the low-frequency driving mode as a result of determination of the normal driving mode or the low-frequency driving mode by the drive control circuit 210 in the display control unit 200 on the basis of the input data DAT from the host 80, the gate driver control signal SgC and the timing control signal SsCT are generated on the basis of the input data DAT, and also, the input image data SsD0 is extracted from the input data DAT, but as the selection control signal Ssw1, the H level is output and is supplied to the data selector 230. Also, in this case, the input image data SsD0 is supplied to the dithering processing circuit 220, and is converted into data according to the area coverage modulation method, and is output as the dithered input image data SsD1. The dithered input image data SsD1 is selected by the data selector 230 on the basis of the H-level selection control signal Ssw1, and is supplied to the source driver 310 as the image signal SsD for driver. In the display unit 500, the scanning signal lines GL1 to GLn are successively selected by the gate driver 320 on the basis of the gate driver control signal SgC, and also, the data signals S1 to Sm are applied to the data signal lines SL1 to SLm, respectively, by the source driver 310 on the basis of the image signal SsD for driver and the timing control signal SsCT. The display unit 500 is driven in this manner, and the pixel data of each pixel formation portion 10 is rewritten, and the display image is thereby refreshed.

In the low-frequency driving mode of the present embodiment, when such refresh is performed in one frame period, driving of the display unit 500 by the gate driver 320 and the source driver 310 is stopped and refresh of display image is not performed during the following 59 frame periods. In the one frame period following the 59 frame periods, the display unit 500 is again driven by the gate driver 320 and the source driver 310, and the display image is refreshed. In this manner, the display unit 500 is driven in such a way that a refresh period of one frame period and a non-refresh period of 59 frame periods appear alternately.

According to the present embodiment as described above, in the normal driving mode, an image represented by the input image data DsD0 according to the continuous tone method is displayed on the display unit 500, but in the low-frequency driving mode, an image represented by the dithered input image data SsD1 according to the area coverage modulation method is displayed on the display unit 500. Accordingly, with a display image in the low-frequency driving mode, the gradation is expressed in binary in a pseudo manner by a maximum value Lmax and a minimum value Lmin that can be taken as the gradation values (pixel values) of pixels in a continuous tone image represented by the input image data. Accordingly, pixels of intermediate gradation values are not included in a display image in the low-frequency driving mode, and thus, brightness drop which is caused during refresh of a display image in pause driving of a conventional liquid crystal display device is reduced or overcome.

Figure 4:
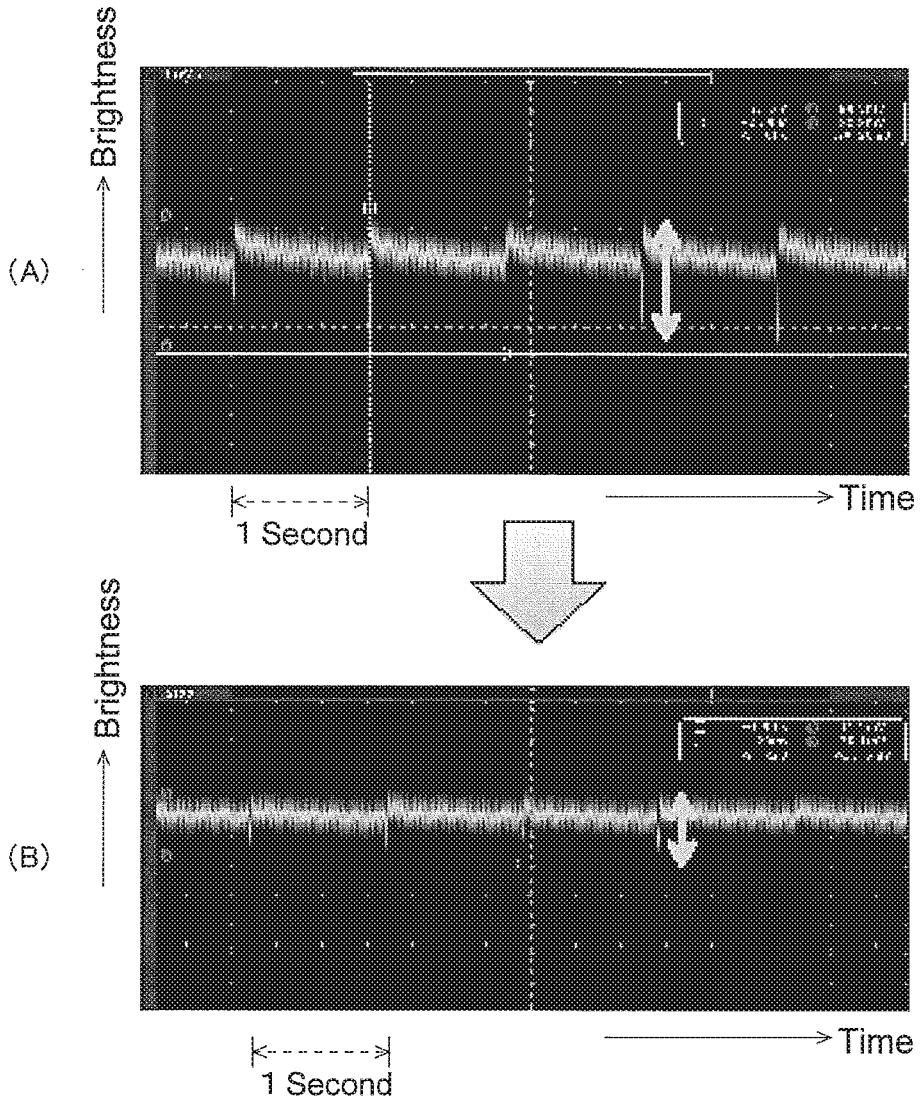
FIGS. 4(A) and 4(B) are brightness waveform diagrams for describing an effect of the first embodiment.

FIGS. 4(A) and 4(B) are brightness waveform diagrams for describing an effect of suppressing the brightness drop according to the present embodiment. FIG. 4(A) is a brightness waveform diagram showing a measurement result of brightness of a display image during pause driving according to a conventional liquid crystal display device, and FIG. 4(B) is a brightness waveform diagram showing a measurement result of brightness of a display image in the low-frequency driving mode according to the liquid crystal display device of the present embodiment. In each of FIGS. 4(A) and 4(B), the horizontal axis represents time, and the vertical axis represents brightness measured by a photosensor for a display image of a gradation value 128 among 256 gradations of gradation values 0 to 255. Additionally, the refresh cycle at the time of measurement is one second. FIGS. 4(A) and 4(B) each show a high-frequency brightness waveform (radically changing brightness waveform), but the brightness at the center of the change in the brightness waveform may be considered to be the brightness as the measurement result. As is clear from the comparison between FIG. 4(A) and FIG. 4(B), the brightness drop at the time of refresh during low-frequency driving is greatly reduced for the present embodiment than in the conventional case.

1.5. Variations

According to the first embodiment described above, in the low-frequency driving mode, input image data SsD0 according to the continuous tone method is converted into dithered input image data SsD1 according to the area coverage modulation method by dithering processing that takes four adjacent pixels (2×2 pixels) as a unit, but the unit of dithering processing is not limited to the adjacent four pixels. By increasing the number of pixels taken as the unit of dithering processing, the number of gradations that can be expressed by image data after dithering processing may be increased.

For example, as shown in FIGS. 5(A) to 5(E), dithering processing may be performed, taking as a unit adjacent six pixels (hereinafter referred to as "3×2 pixels"), with two pixels adjacent to each other in the horizontal direction and three pixels adjacent to one another in the vertical direction. FIGS. 5(A) to 5(E) show examples of dithering processing where the gradation value that may be taken by a pixel of an image represented by the input image data SsD0 ranges from 0 to 255. In these examples, a gradation value 43 is obtained by making the gradation value (pixel value) of one pixel among the adjacent six pixels, as a unit of dithering processing, 255 and the gradation values (pixel values) of the remaining five pixels 0 as shown in FIG. 5(A). Also, a gradation value 85 is obtained by making the gradation values of two pixels among the adjacent six pixels 255 and the gradation values of the remaining four pixels 0 as shown in FIG. 5(B), a gradation value 128 is obtained by making the gradation values of three pixels among the adjacent six pixels 255 and the gradation values of the remaining three pixels 0 as shown in FIG. 5(C), a gradation value 170 is obtained by making the gradation values of four pixels among the adjacent six pixels 255 and the gradation values of the remaining two pixels 0 as shown in FIG. 5(D), and a gradation value 211 is obtained by making the gradation values of five pixels among the adjacent six pixels 255 and the gradation value of the remaining one pixel 0 as shown in FIG. 5(E). Additionally, the gradation values of the adjacent six pixels are all made 0 for a gradation value 0, and the gradation values of the adjacent six pixels are all made 255 for a gradation value 255. Accordingly, in the case where the average gradation value of adjacent six pixels of the input image data SsD0 is equal to any one of seven gradation values of 0, 43, 85, 128, 170, 211 and 255, the dithering processing circuit 220 of the present variation converts the adjacent six pixels into adjacent six pixels of binary pixels corresponding to the average gradation value. Also, in the case where the average gradation value of adjacent six pixels of the input image data SsD0 is a gradation value other than the seven gradation values of 0, 43, 85, 128, 170, 211 and 255, the dithering processing circuit 220 of the present variation performs conversion into adjacent six pixels of binary pixels corresponding to a gradation value that is closest to the average gradation value (that is, a gradation value that is assumed to be equal to the average gradation value within a predetermined error range) among the seven gradation values.

Figures 5, 6:
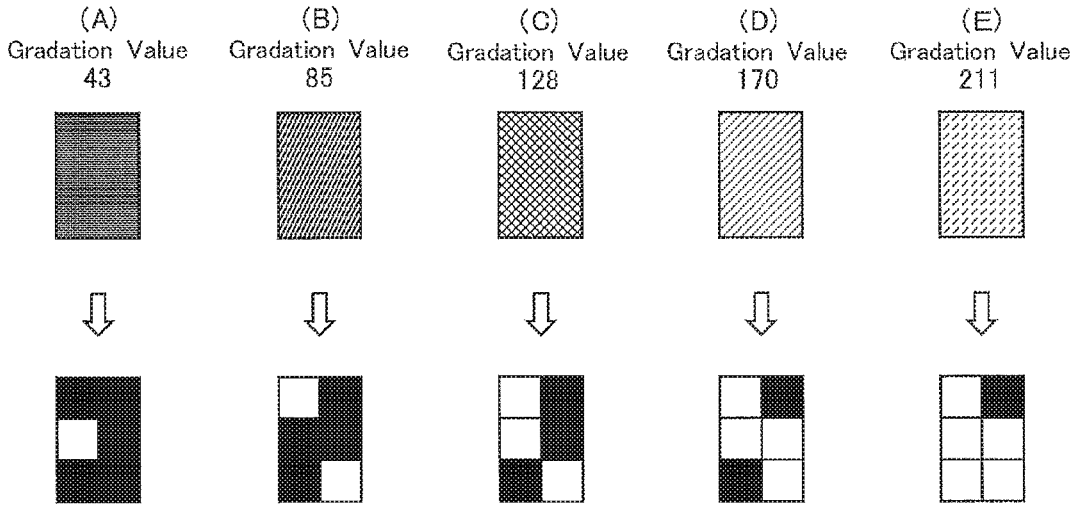
FIG. 6 is a diagram showing an example of a dither matrix that is used in the dithering processing according to a variation of the first embodiment.

Additionally, as a specific procedure of dithering processing, in addition to the procedure described above, a well-known method of setting a dither matrix where each element has a value depending on the number of gradations, and performing comparison with a corresponding pixel value (gradation value) of the input image data SsD0 according to the continuous tone method may be used (the same applies to the other embodiments). For example, in the case of performing dithering processing on the input image data SsD0 for which the gradation value may take a value ranging from 0 to 255, with adjacent 16 pixels (4×4 pixels) as a unit, a dither matrix as shown in FIG. 6 may be used. In this case, the gradation values (pixel values) of the input image data SsD0 are compared with the dither matrix in FIG. 6 for each adjacent 16 pixels (4×4 pixels), and if a pixel value of the input image data SsD0 is greater than a corresponding element in the dither matrix, the pixel value is changed to 255, and if a pixel value is equal to or smaller than the corresponding element in the dither matrix, the pixel value is changed to 0. Such processing is repeated for each adjacent 16 pixels of the input image data SsD0, and the dithered input image data SsD1 is thereby obtained as the input image data according to the area coverage modulation method.

According to the first embodiment described above, each pixel of an image to be displayed is formed by any of the pixel formation portions 10 in the display unit 500, but in the case where the image to be displayed is a color image and each pixel is constituted by a plurality of subpixels corresponding to a plurality of primary colors, dithering processing is performed for each of the plurality of primary colors. For example, in the case where each pixel of an image to be displayed is constituted by a red subpixel (hereinafter referred to as "R subpixel"), a green subpixel (hereinafter referred to as "G subpixel"), and a blue subpixel (hereinafter referred to as "B subpixel"), if dithering processing is to be performed taking adjacent four pixels as a unit, for example, the dithered input image data SsD1 according to the area coverage modulation method may be generated by performing dithering processing as shown in FIGS. 3(A) to 3(C) on the four R subpixels of the adjacent four pixels, performing dithering processing as shown in FIGS. 3(A) to 3(C) on the four G subpixels of the adjacent four pixels, and performing dithering processing as shown in FIGS. 3(A) to 3(C) on the four B subpixels of the adjacent four pixels. Additionally, the dithering processing described above for display of a color image as described above where each pixel is constituted by a plurality of subpixels is applicable in the same manner to a color image display device as a variation of another embodiment.

2. Second Embodiment

Figure 7:
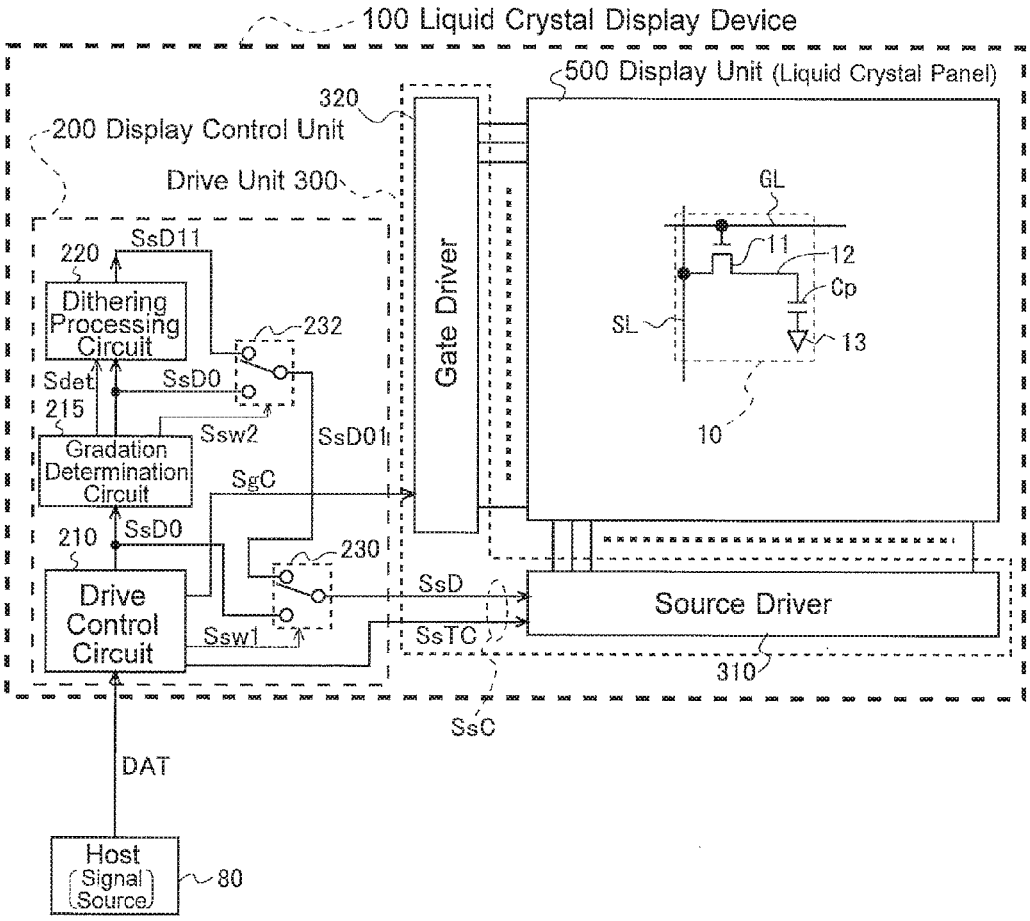
FIG. 7 is a block diagram showing a configuration of a liquid crystal display device according to a second embodiment of the present invention.

FIG. 7 is a block diagram showing a configuration of a liquid crystal display device 100 according to a second embodiment of the present invention. The liquid crystal display device 100 is the same as the liquid crystal display device according to the first embodiment shown in FIG. 1 except for the configuration of the display control unit 200, and corresponding parts are denoted by the same reference characters and detailed description thereof is omitted. In the following, the configuration, operation and the like of the display control unit 200 according to the present embodiment will be mainly described.

2.1. Configurations of Main Parts

Also in the present embodiment, as in the first embodiment, the display control unit 200 receives input data DAT including input image data SsD0 from the host 80, and accordingly, generates a source driver control signal SsC, a gate driver control signal SgC, a common voltage signal and the like. The source driver control signal SsC includes an image signal SsD for driver and a timing control signal SsCT. As in the first embodiment, the display control unit 200 has the normal driving mode and the low-frequency driving mode (see FIG. 2) with respect to driving of the display unit 500 by the drive unit 300. Additionally, in the present embodiment, the dithering processing circuit 220, a gradation determination circuit 215, and a second data selector 232 constitute an image processing unit for performing a process of converting the gradation method of input image data, and the operation of the image processing unit is stopped in the normal driving mode in the present embodiment.

As shown in FIG. 7, the display control unit 200 of the present embodiment includes the gradation determination circuit 215 and the second data selector 232, in addition to the drive control circuit 210, the dithering processing circuit 220, and the data selector (hereinafter referred to as "first data selector" so as to be distinguished from the data selector 232) 230. The drive control circuit 210 generates, on the basis of input data DAT from the host 80, a gate driver control signal SgC and a timing control signal SsCT for source driver, and also, extracts and outputs input image data SsD0 from the data DAT, and furthermore, generates a first selection control signal Ssw1. The gate driver control signal SgC is supplied to the gate driver 320, the timing control signal SsCT is supplied to the source driver 310, and the first selection control signal Ssw1 is supplied to the first data selector 230. The input image data SsD0 is digital data representing an image to be displayed according to the continuous tone method, and is supplied to the gradation determination circuit 215 and the first data selector 230.

The gradation determination circuit 215 determines, on the basis of the input image data SsD0, whether any of a plurality of types of dithering processing prepared in advance is allowed or not for each set of a predetermined number of adjacent pixels (for example, for each set of 2×2 pixels), and outputs a signal Sdet indicating the determination result (hereinafter referred to as "determination result signal"), and also, outputs a second selection control signal Ssw2 according to the determination result. The determination result signal Sdet is input to the dithering processing circuit 220, and the second selection control signal Ssw2 is input to the second data selector 232. Additionally, in the case where any of the plurality of types of dithering processing is determined to be allowed, the determination result signal Sdet includes identification information of the allowed dithering processing. Also, the input image data SsD0 is supplied to the dithering processing circuit 220 and the second data selector 232 through the gradation determination circuit 215.

If any of the plurality of types of dithering processing is allowed according to the determination result signal Sdet, the dithering processing circuit 220 converts the input image data SsD0 according to the continuous tone method to dithered input image data SsD11 according to the area coverage modulation method by the allowed dithering processing, and supplies the dithering input image data SsD11 to the second data selector 232. On the other hand, if none of the plurality of types of dithering processing is allowed, the dithering processing circuit 220 stops its operation, and the input image data SsD0 is not subjected to any dithering processing.

According to the second selection control signal Ssw2, the second data selector 232 selects the input image data SsD0 according to the continuous tone method if none of the plurality of types of dithering processing is allowed, and selects, if any of the plurality of types of dithering processing is allowed, the dithered input image data SsD11 obtained by the allowed dithering processing. As described above, whether any of the plurality of types of dithering processing is allowed or not is determined for each set of pixels of a predetermined number, and thus, the selection operation by the second data selector 232 is performed for each set of pixels of the predetermined number. Accordingly, data according to the continuous tone method and data according to the area coverage modulation method are normally mixed in the image data that is output from the second data selector 232, and the image data that is output is supplied to the first data selector 230 as partially dithered input image data SsD01.

The first selection control signal Ssw1 generated by the drive control circuit 210 is a signal indicating the normal driving mode or the low-frequency driving mode. Based on the first selection control signal Ssw1, the first data selector 230 selects, in the normal driving mode, the input image data SsD0 according to the continuous tone method, and supplies the same to the source driver 310 as the image signal SsD for driver, and selects, in the low-frequency driving mode, the partially dithered input image data SsD01, and supplies the same to the source driver 310 as the image signal SsD for driver.

2.2. Details of Dithering Processing

Figure 8:
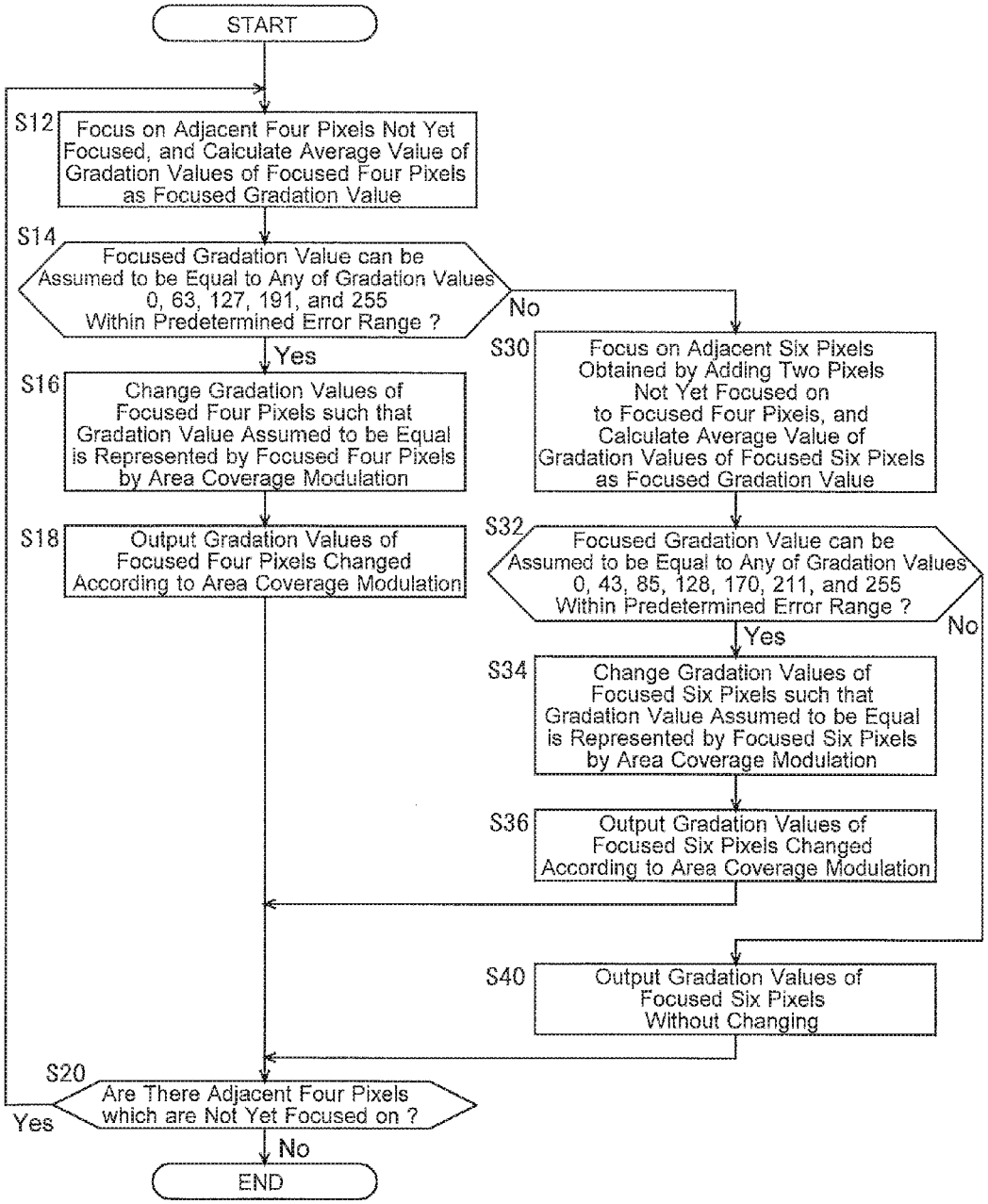
FIG. 8 is a flow chart showing a procedure of dithering processing according to the second embodiment.

According to the present embodiment described above, in the low-frequency driving mode, the input image data SsD0 according to the continuous tone method is converted into the partially dithered input image data SsD01 by the gradation determination circuit 215, the dithering processing circuit 220, and the second data selector 232, and the partially dithered input image data SsD01 is supplied to the source driver 310 as the image signal SsD for driver. FIG. 8 is a flow chart showing a procedure of dithering processing that is performed by the image processing unit (the dithering processing circuit 220, the gradation determination circuit 215, and the second data selector 232) to obtain the partially dithered input image data SsD01. In the following, details of the dithering processing in the low-frequency driving mode in the present embodiment will be given with reference to FIG. 8. Additionally, in the following, the number of gradations of the input image data SsD0 is 256, and the value that can be taken as the gradation value ranges from 0 to 255, but the present invention is not limited thereto.

When the input image data SsD0 according to the continuous tone method is supplied by the drive control circuit 210 to the gradation determination circuit 215, the gradation determination circuit 215 successively focuses on adjacent four pixels (2×2 pixels) in the input image data SsD0, and calculates the average value of the gradation values (pixel values) of the focused four pixels as a focused gradation value (step S12). Next, it is determined whether the focused gradation value can be assumed to be equal to any of gradation values 0, 63, 127, 191 and 255 that can be expressed in binary (gradation values 0, 255) in a pseudo manner by four pixels (hereinafter, these five gradation values will be referred to as "four-pixel gradation pseudo-representable value(s)") within a predetermined error range (step S14). The predetermined error range here is a range of $\pm\alpha$ (where $\alpha$ is a positive number equal to or smaller than $256/(5-1)/2=32$) centered on each of the four-pixel gradation pseudo-representable values, and for example, when $\alpha=16$ is true, if the focused gradation value is within the range of 0 to 16, it can be determined to be equal to the gradation value 0, if the focused gradation value is within the range of 47 to 79, it can be determined to be equal to the gradation value 63, if the focused gradation value is within the range of 111 to 143, it can be determined to be equal to the gradation value 127, if the focused gradation value is within the range of 175 to 207, it can be determined to be equal to the gradation value 191, and if the focused gradation value is within the range of 239 to 255, it can be determined to be equal to the gradation value 255.

In the case where it is determined by the gradation determination circuit 215 that the focused gradation value can be assumed to be equal to one of the four-pixel gradation pseudo-representable values within the predetermined error range, the dithering processing circuit 220 performs conversion into adjacent four pixels of binary pixels expressing in a pseudo manner, according to the area coverage modulation method, the gradation value that is assumed to be equal (see FIGS. 3(A) to 3(C)) (step S16). For example, when $\alpha=16$ is true, the focused gradation value 132 is assumed to be equal to 127 among the four-pixel gradation pseudo-representable values, and as shown in FIG. 3(B), the focused four pixels are converted into adjacent four pixels including two pixels of gradation value 255 and two pixels of gradation value 0.

Data of the adjacent four pixels dithered in the above manner is output from the display control unit 200 through the second data selector 232 and the first data selector 230, and is supplied to the source driver 310 as pixel data constituting the image signal SsD for driver (step S18).

Then, the gradation determination circuit 215 determines whether there are adjacent four pixels (2×2 pixels) not yet focused on in the input image data SsD0 from the drive control circuit 210, and if there are adjacent four pixels not yet focused on, the process returns to step S12 to be repeated from step S12.

In step S14, if the focused gradation value is determined to be not equal to any of the four-pixel gradation pseudo-representable values within the predetermined error range, the gradation determination circuit 215 focuses on adjacent six pixels obtained by adding, to the focused four pixels, two pixels which are not yet focused on in the input image data SsD0 from the drive control circuit 210, and calculates the average value of the gradation values of the focused six pixels as the new focused gradation value (step S30). Next, it is determined whether the focused gradation value can be assumed to be equal to any of gradation values 0, 43, 85, 128, 170, 211 and 255 that can be expressed in binary (gradation values 0, 255) in a pseudo manner by six pixels (hereinafter, these seven gradation values will be referred to as "six-pixel gradation pseudo-representable value(s)") within a predetermined error range (step S32). The predetermined error range here is a range of $\pm\alpha$ (where a is a positive number equal to or smaller than $256/(7-1)/2=21.3$) centered on each of the six-pixel gradation pseudo-representable values, and for example, when $\alpha=16$ is true, if the focused gradation value is within the range of 0 to 16, it can be determined to be equal to the gradation value 0, if the focused gradation value is within the range of 27 to 59, it can be determined to be equal to the gradation value 43, if the focused gradation value is within the range of 69 to 101, it can be determined to be equal to the gradation value 85, if the focused gradation value is within the range of 116 to 144, it can be determined to be equal to the gradation value 128, if the focused gradation value is within the range of 154 to 186, it can be determined to be equal to the gradation value 170, if the focused gradation value is within the range of 194 to 227, it can be determined to be equal to the gradation value 211, and if the focused gradation value is within the range of 239 to 255, it can be determined to be equal to the gradation value 255.

In the case where it is determined by the gradation determination circuit 215 that the focused gradation value can be assumed to be equal to one of the six-pixel gradation pseudo-representable values within the predetermined error range, the dithering processing circuit 220 performs conversion into adjacent six pixels of binary pixels expressing in a pseudo manner, according to the area coverage modulation method, the gradation value that is assumed to be equal (see FIGS. 5(A) to 5(E)) (step S34). For example, when $\alpha=16$ is true, the focused gradation value 98 is assumed to be equal to 85 among the six-pixel gradation pseudo-representable values, and as shown in FIG. 5(B), the focused six pixels are converted into adjacent six pixels including two pixels of gradation value 255 and four pixels of gradation value 0.

Data of the adjacent six pixels dithered in the above manner is output from the display control unit 200 through the second data selector 232 and the first data selector 230, and is supplied to the source driver 310 as pixel data constituting the image signal SsD for driver (step S36).

Then, the process is performed from step S20 described above.

In step S32, if the focused gradation value is determined to be not equal to any of the six-pixel gradation pseudo-representable values within the predetermined error range, the focused six pixels in the input image data SsD0 according to the continuous tone method supplied to the gradation determination circuit 215 are output as they are (without being subjected to dithering processing) from the display control unit 200 through the second data selector 232 and the first data selector 230, and are supplied to the source driver 310 as pixel data constituting the image signal SsD for driver (step S40).

Then, the gradation determination circuit 215 determines whether there are adjacent four pixels (2×2 pixels) not yet focused on in the input image data SsD0 from the drive control circuit 210 (step S20). If there are adjacent four pixels not yet focused on according to the result of determination, the process returns to step S12 to be repeated from step S12 (the processes described above), but if there are no adjacent four pixels which are not yet focused on, the dithering processing of the present embodiment is ended. Thereafter, if input image data SsD0 based on new input data DAT from the host 80 is supplied from the drive control circuit 210 to the gradation determination circuit 215, the dithering processing in FIG. 8 is started again.

2.3. Operation and Effect

According to the present embodiment as described above, in the normal driving mode, refresh of the display image by driving of the display unit 500 is repeatedly performed at an interval of one frame period as in the first embodiment described above. On the other hand, in the low-frequency driving mode, data in which data which has been dithered in units of adjacent four pixels, data which has been dithered in units of adjacent six pixels, and data which has not been subjected to dithering processing are mixed, that is, partially dithered input image data SsD01 is generated from input image data SsD0 according to the continuous tone method (see steps S14, S16, S32, and S40 in FIG. 8), and the partially dithered input image data SsD01 is supplied to the source driver 310 as the image signal SsD for driver. Accordingly, reduction in the gradation reproducibility by the dithering processing in the low-frequency driving mode may be suppressed compared to the first embodiment. On the other hand, if the proportion of data which is not subjected to dithering processing is increased in the partially dithered input image data SsD01, the effect of suppressing the brightness drop at the time of refresh of a display image is reduced. In this manner, the gradation reproducibility and the effect of suppressing the brightness drop in the low-frequency driving mode are in the relationship of trade-off, and the trade-off between the two may be adjusted by setting the predetermined error range (a) described above. Accordingly, the present embodiment may achieve a unique effect that the brightness drop at the time of refresh of a display image may be reduced in the low-frequency driving while taking into account the relationship of trade-off to the gradation reproducibility.

2.4. Variation

In the second embodiment described above, determination of whether a focused gradation value is representable in a pseudo manner within the predetermined error range is performed in two stages (steps S14, S32 in FIG. 8), but the determination may be performed in one stage, or in three or more stages. If the determination is to be performed in only one stage in the dithering processing shown in FIG. 8, steps S30 to S40 are omitted, and in the case where a focused gradation value (the average value of the gradation values of focused four pixels) is determined to be not equal to any of the four-pixel gradation pseudo-representable values within the predetermined error range (step S14), the focused four pixels in the input image data SsD0, according to the continuous tone method, supplied to the gradation determination circuit 215 are output as they are from the display control unit 200 through the second data selector 232 and the first data selector 230.

Also, in the second embodiment described above, the units of dithering processing are adjacent four pixels (2×2 pixels) and adjacent six pixels (3×2 pixels), but the units of dithering processing of the present invention are not limited thereto.

3. Other Variations

In each of the embodiments described above, description has been given citing a liquid crystal display device that performs pause driving and that has a low-frequency driving mode as an example, but the present invention is not limited thereto, and is applicable to other display devices such as an organic electro luminescence (EL) display device and the like, as long as the display device performs pause driving.

Furthermore, the display control unit 200 according to each of the embodiments described above is implemented as hardware (see FIGS. 1 and 7), but a part or all of the functions of the display control unit 200 may be implemented as software instead by execution of predetermined programs by a CPU or the like.

INDUSTRIAL APPLICABILITY

The present invention may be applied to a display device that performs pause driving, and a method for driving the same.

DESCRIPTION OF REFERENCE CHARACTERS

10: Pixel Formation Portion
11: Thin Film Transistor (Switching Element)
80: Host (Signal Source)
100: Liquid Crystal Display Device
200: Display Control Unit
210: Drive Control Circuit
215: Gradation Determination Circuit
220: Dithering Processing Circuit
230: Data Selector (First Data Selector)
232: Second Data Selector
300: Drive Unit
310: Source Driver (Data Signal Line Drive Circuit)
320: Gate Driver (Scanning Signal Line Drive Circuit)
Cp: Pixel Capacitance
DAT: Input Data
Sdet: Determination Result Signal
Ssw1: Selection Control Signal (First Selection Control Signal)
Ssw2: Second Selection Control Signal
SsD0: Input Image Data (Image Data According To Continuous Tone Method)
SsD1: Dithered Input Image Data
SsD01: Partially Dithered Input Image Data
SsCT: Timing Control Signal
SsD: Image Signal for Driver
SgC: Gate Driver Control Signal
SsC: Source Driver Control Signal

The invention claimed is:

1. A display device for receiving an input signal including image data according to a continuous tone method from outside, and displaying an image based on the input signal, the display device comprising:

a display unit;

a drive unit configured to drive the display unit; and a display control unit configured to control the drive unit so that an image is displayed on the display unit based on the input signal, the display device having:

a normal driving mode in which the display unit is driven in such a way that a refresh period appears continuously, the refresh period being a period during which a display image on the display unit is refreshed; and a low-frequency driving mode in which the display unit is driven in such a way that the refresh period and a non-refresh period appear alternately, the non-refresh period being a period during which refresh of the display image on the display unit is paused, the display control unit including an image processing unit configured to perform, on a part or all of the image data, in the low-frequency driving mode, a conversion process of converting a gradation method so that the image is displayed on the display unit according to an area coverage modulation method.

2. The display device according to claim 1, wherein the image processing unit performs the conversion process on the image data in such a way that a gradation is expressed in a pseudo manner by a dithering method that takes a plurality of pixels as a unit.

3. The display device according to claim 1, wherein the image processing unit performs the conversion process on the image data in such a way that pixels, among pixels in a continuous tone image represented by the image data, whose gradations are representable within a predetermined error range by a dithering method that takes two or a greater predetermined number of pixels as a unit are changed to pixels according to the dithering method, and that pixels, among the pixels in the continuous tone image, whose gradations are not representable within the predetermined error range by the dithering method remain as pixels according to the continuous tone method.

4. The display device according to claim 1, wherein the image processing unit determines in advance, as numbers of pixels as units of gradation representation by the dithering method, at least two numbers of pixels including a first number of pixels and a second number of pixels greater than the first number of pixels, and performs the conversion process on the image data in such a way that pixels, among pixels in a continuous tone image represented by the image data, whose gradations are representable within a predetermined error range by a first dithering method that takes the first number of pixels as a unit are changed to pixels according to the first dithering method, that pixels, among the pixels in the continuous tone image, whose gradations are not representable within the predetermined error range by the first dithering method but are representable within a predetermined error range by a second dithering method that takes the second number of pixels as a unit are changed to pixels according to the second dithering method, and that pixels, among the pixels in the continuous tone image, whose gradations are not representable within a predetermined error range by the dithering method that takes either of the at least two numbers of pixels as a unit remain as pixels according to the continuous tone method.

5. The display device according to claim 1, wherein the area coverage modulation method is a method that expresses a gradation, in a pseudo manner, by a dithering method that uses two values of a maximum gradation value and a minimum gradation value that can be taken by a pixel in an image represented by the image data.

6. The display device according to claim 1, wherein the display unit includes, as a switching element for forming each pixel constituting an image to be displayed, a thin film transistor whose channel layer is formed of an oxide semiconductor.

7. A method for driving a display device for receiving an input signal including image data according to a continuous tone method from outside, and displaying an image on a display unit based on the input signal, the method comprising a driving control step of driving the display unit so that an image is displayed on the display unit based on the input signal, wherein the display device has a normal driving mode and a low-frequency driving mode, wherein the driving control step includes a normal driving step of driving in the normal driving mode the display unit in such a way that a refresh period appears continuously, the refresh period being a period during which a display image on the display unit is refreshed, a low-frequency driving step of driving in the low-frequency driving mode the display unit in such a way that the refresh period and a non-refresh period appear alternately, the non-refresh period being a period during which refresh of the display image on the display unit is paused, and an image processing step of performing, on a part or all of the image data, in the low-frequency driving mode, a conversion process of converting a gradation method so that the image is displayed on the display unit according to an area coverage modulation method.

8. The method for driving according to claim 7, wherein the area coverage modulation method is a method that expresses a gradation, in a pseudo manner, by a dithering method that uses two values of a maximum gradation value and a minimum gradation value that can be taken by a pixel in an image represented by the image data.

* * * * *